US005164554A

United States Patent [19]

Ikunami

[11] Patent Number: 5,164,554

[45] Date of Patent: Nov. 17, 1992

[54] PIVOTABLE PUSHBUTTON OPERATED MULTIPLE SWITCH ASSEMBLY

[75] Inventor: Takahiro Ikunami, Hyogo, Japan

[73] Assignee: Mitsubishi Denki Kabushiki Kaisha, Tokyo, Japan

[21] Appl. No.: 669,533

[22] Filed: Mar. 14, 1991

[30] Foreign Application Priority Data

Jul. 10, 1990 [JP] Japan ..... 2-180429

[51] Int. Cl.[5] ..... H01H 9/00; H01H 25/04; H01H 13/64

[52] U.S. Cl. ..... 200/5 E; 200/6 A; 200/557; 200/339

[58] Field of Search ..... 200/5 R, 5 A, 6 A, 557, 200/339, 341, 344, 5 E

[56] References Cited

U.S. PATENT DOCUMENTS

| | | | |
|---|---|---|---|
| 4,029,915 | 6/1977 | Ojima | 200/6 A X |
| 4,401,864 | 8/1983 | Ickikawa | 200/339 X |
| 4,439,648 | 3/1984 | Reiner et al. | 200/6 A |
| 4,486,629 | 12/1984 | Sledesky | 200/6 A |
| 4,520,240 | 5/1985 | Swindler | 200/339 X |
| 4,687,200 | 8/1987 | Shirai | 200/339 X |

FOREIGN PATENT DOCUMENTS 51-68726 6/1976 Japan .

*Primary Examiner*—J. R. Scott

[57] ABSTRACT

A plurality of switches are arranged in a polygon on a printed circuit board and each of the switches is beneath or under a switch activating portion formed at the center of a pushbutton operation receiver portion. The pushbutton operation receiver portions are each supported over the corresponding switches through resilient arms that are integrally formed with a stay, which is secured to the printed circuit board at the center of the polygon. The pushbutton has a plurality of pushbutton operation transmission portions, each of which conveys the pressing force to the facing ends of the adjacent pushbutton operation receiver portions. When the pushbutton is depressed at a point between two switches, the pushbutton operation transmission portion nearest the depression point is lowered, pushing down the facing ends of the adjacent pushbutton operation receiver portions. Since only one end of each of the two adjacent pushbutton operation receiver portions is pushed down, these pushbutton operation receiver portions are inclined but not lowered, so that the switch activting portion at the center of each pushbutton operation receiver portion is not lowered, leaving the corresponding switches inactivated. in this way no two or more switches can be operated simultaneously.

9 Claims, 5 Drawing Sheets

PIVOTABLE PUSHBUTTON OPERATED MULTIPLE SWITCH ASSEMBLY

BACKGROUND OF THE INVENTION

1. Field of the Invention

The present invention relates to a pushbutton operated multiple switch assembly by which only one of a plurality of switches arranged on a printed circuit board can be activated.

2. Prior Art

FIGS. 5A, 5B and 5C are cross sections showing one example of a conventional pushbutton mechanism. In the figures, reference numeral I represents a pushbutton whose cross section is shaped like a letter U upside down. Designated 2*a*, 2*b*, 2*c* and 2*d* are first to fourth switch activating portions located on the peripheral portion of and formed integral with the pushbutton I. These switch activating portions form a part of the printed circuit board. Denoted 3*a*, 3*b*, 3*c* and 3*d* are first to fourth switches located at the centers of the sides of a quadrangle on a printed circuit board 4. Numeral 5 is a decorative surface panel. A cushion 6 is installed between the printed circuit board 4 and the pushbutton 1 to support the pushbutton 1.

Now, the operation of the above pushbutton mechanism will be described. When a point on the pushbutton 1 above the first switch 3*a* is depressed, the pushbutton 1 is inclined compressing the cushion 6, causing the first switch activating portion 2*a* to move down to energize the first switch 3*a*. Next, when the pushbutton 1 is released, it returns to its original position by the recovering force of the cushion 6, resetting the switch 3*a*. The second to fourth switches 3*b*, 3*c*, 3*d* also perform the same operation.

The conventional pushbutton mechanism of the above construction has the following drawback. When a point on the pushbutton 1 between the first and second switches 3*a*, 3*b* is pushed, both the first switch activating portion 2*a* and the second switch activating portion 2*b* move down turning on the first and second switches 3*a*, 3*b* simultaneously. This could happen for other combinations of second and third switches 3*b*, 3*c*, of third and fourth switches 3*c*, 3*d*, and of fourth and first switches 3*d*, 3*a*. When the pushbutton 1 is pressed at an intermediate point of the four switches 3*a*, 3*b*, 3*c*, 3*d*, the entire pushbutton 1 moves down causing all four switch activating portions 2*a*, 2*b*, 2*c*, 2*d* to turn on all the four switches 3*a*, 3*b*, 3*c*, 3*d* at one time. To avoid activating two or more switches 3*a*, 3*b*, 3*c*, 3*d* simultaneously requires an operator to use caution in selecting and pressing the correct position on the pushbutton 1.

SUMMARY OF THE INVENTION

The present invention has been accomplished with a view to overcoming the above drawback and its objective is to provide a pushbutton mechanism in which no two or more switches can be turned on simultaneously, whatever position the pushbutton is pressed at or whatever force it is pressed with, so that only one switch can reliably be turned on at one pressing action.

A pushbutton mechanism according to this invention comprises: a stay secured to the printed circuit board at the center of a polygon formed by a plurality of switches; a plurality of pushbutton operation receiver portions, each having a switch activating portion formed at the center thereof and placed on or over the corresponding switch, said pushbutton operation receiver portions being formed integral with, and suspended by, the stay through resilient arms that extend from the stay; and a pushbutton supported by the stay, said pushbutton having pushbutton operation transmission portions each of which is adapted to press against the ends of the adjacent pushbutton operation receiver portions.

When a point on the pushbutton above the middle of adjacent switches is pressed, only one end of each of the adjacent pushbutton operation receiver portions is lowered, so that the switch activating portion located at the center of each of the pushbutton operation receiver portions is prevented from moving down, thus leaving the switch inactivated.

Further scope of applicability of the present invention will become apparent form the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENT OF THE INVENTION

Figure 1C:
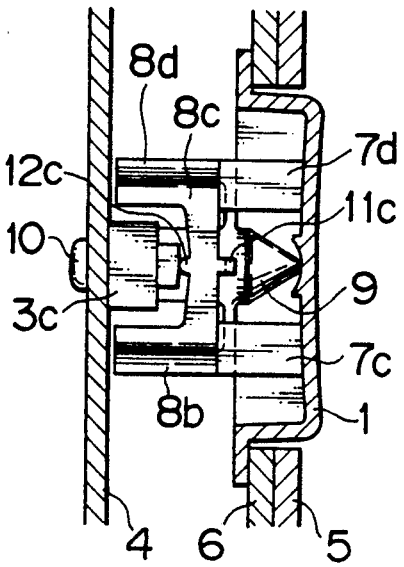
FIGS. 1A, 1B and 1C are cross sections showing a pushbutton mechanism as one embodiment of this invention.
Figure 1A:
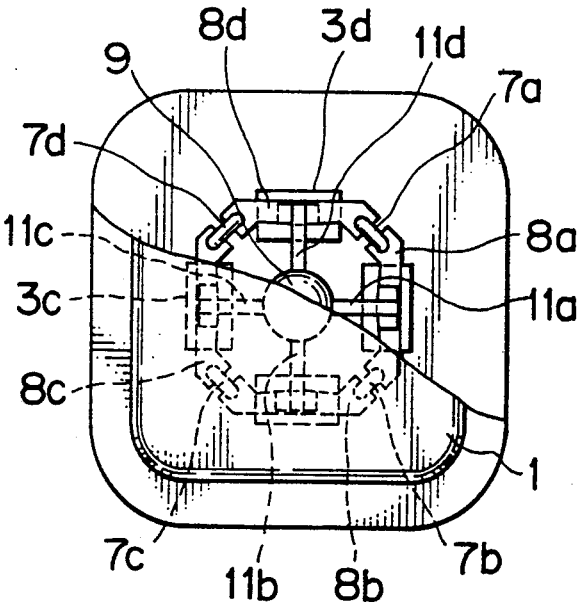
Figure 1B:
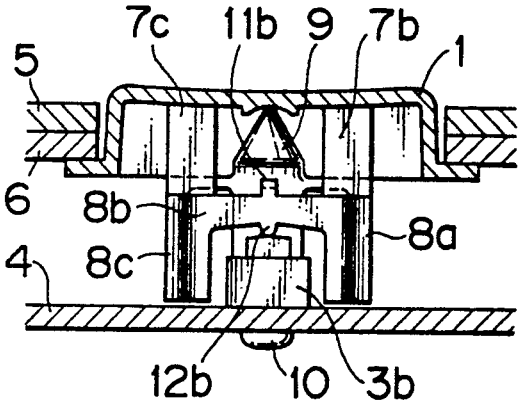

FIG. 1A to 1C are cross sections showing one embodiment of this invention. Reference number 1 denotes a pushbutton with a different shape than that of the conventional pushbutton. Parts 3 to 6 are equivalent to the corresponding parts of the conventional pushbutton mechanism. Numerals 7*a*, 7*b*, 7*c*, 7*d* are first to fourth pushbutton operation transmission portions and numerals 8*a*, 8*b*, 8*c*, 8*d* denote first to fourth pushbutton operation receiver portions to receive the first to fourth pushbutton operation transmission portions 7*a* to 7*d*. At the center of each pushbutton operation receiver portion 7*a* to 7*d* there is formed a first to fourth switch activating portion 12*a*, 12*b*, 12*c*, 12*d* that activates a first to fourth switch 3*a* to 3*d*. The pushbutton operation receiver portions 8*a* to 8*d* are disposed above a printed circuit board 4 with a slight gap between their lower ends and the board. A stay 9 is secured to the printed circuit board 4 by a screw 10. First to fourth thin resilient arms 11*a*, 11*b*, 11*c*, 11*d* are formed integral with the stay 9 and also with the first to fourth pushbutton operation receiver portions 8*a* to 8*d*.

Figure 2C:
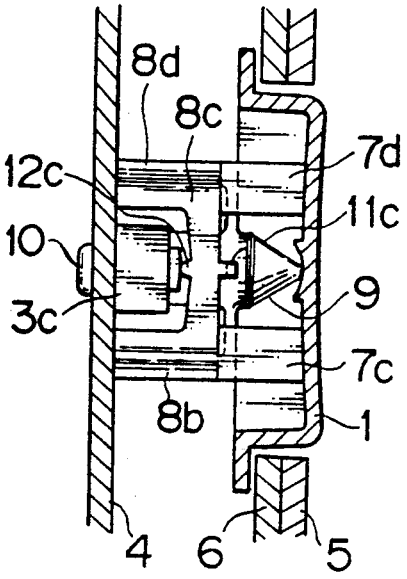
FIGS. 2A, 2B and 2C and FIGS. 3A, 3B and 3C are cross sections showing the operation of the pushbutton mechanism shown in FIG. 1.
Figure 2A:
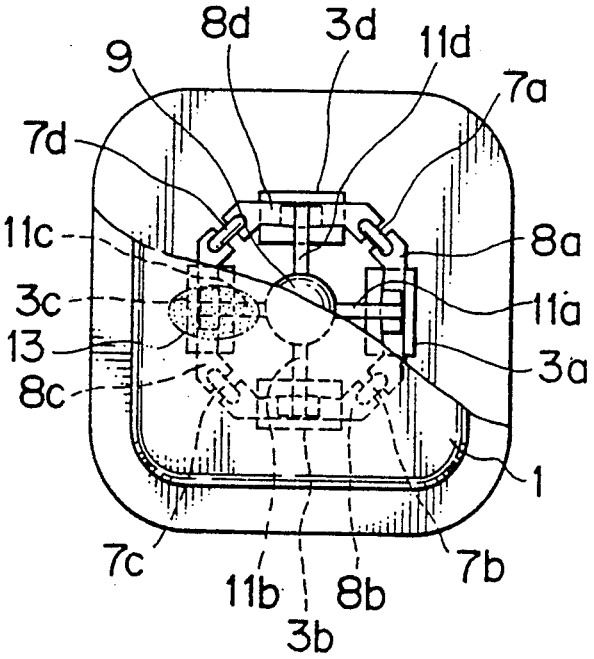
Figure 2B:
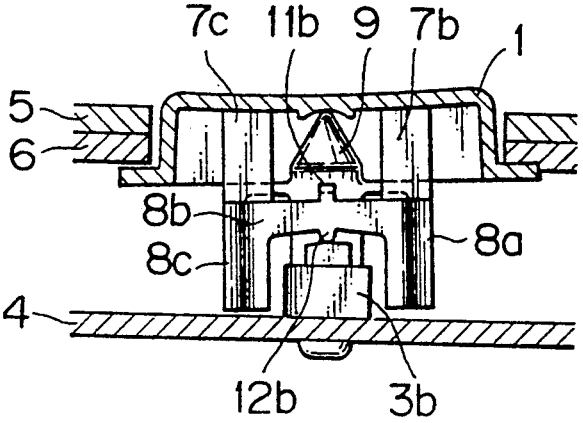

In the pushbutton mechanism of the above construction, when as shown in FIGS. 2A to 2C a point 13 on the pushbutton 1 above the third switch 3*c* is pressed, both the third and fourth pushbutton operation transmission portions 7c, 7d are lowered pushing down the third pushbutton operation receiver portion 8c, which in turn deflects the third thin resilient arm 11c as it moves down. The lowering motion of the third pushbutton operation receiver portion 8c causes the third switch activating portion 12c, which is an integral part of the third pushbutton operation receiver portion 8c, to press the third switch 3c to turn it on. At this time, the second pushbutton operation receiver portion 8b disposed at right angles with the third pushbutton operation receiver portion 8c is inclined by the lowering third pushbutton operation transmission portion 7c, with the second thin resilient arm 11b distorted. However, since the second switch activating portion 12b is not lowered, the second switch 3b is not activated. The fourth pushbutton operation receiver portion 8d disposed on the other side of and perpendicular to the third pushbutton operation receiver portion 8b behaves the same way, leaving the fourth switch 3d inactivated. As to the first pushbutton operation receiver portion 8a disposed opposite the third pushbutton operation receiver portion 8c, since the first and second pushbutton operation transmission portions 7a, 7b are at the lifted positions, the first pushbutton operation receiver portion 8a is not affected at all, so that the first switch 3a is not activated.

When the pushbutton 1 is released, it returns to the original position by the recovering force of the cushion 6, resetting the third switch 3c. The above-mentioned operation also applies to the first, second and fourth switches 3a, 3b, 3d.

Figure 3C:
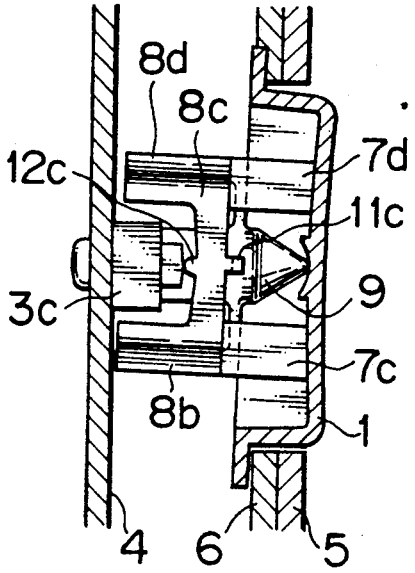
Figure 3A:
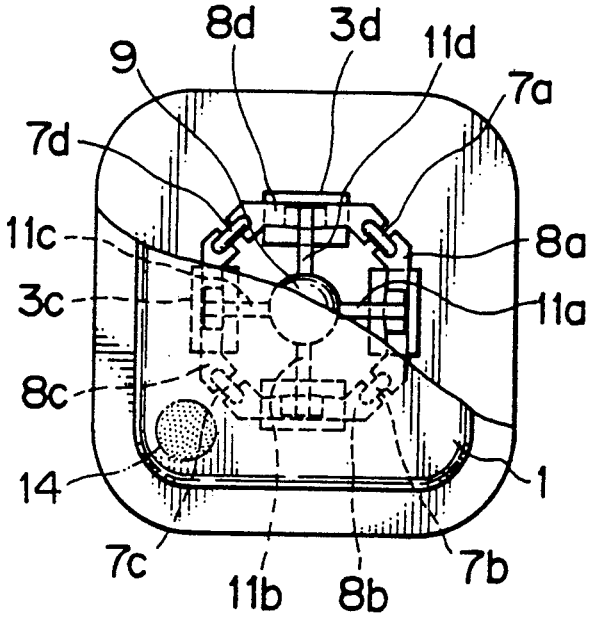
Figure 3B:
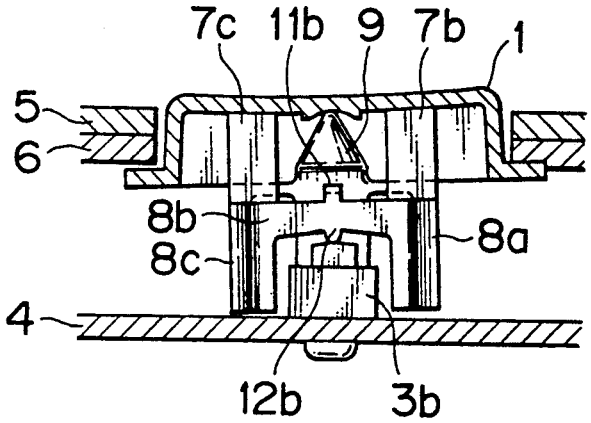

The above description concerns the case where the pushbutton is pressed at a point immediately above the corresponding switch 3a, 3b, 3c, 3d. Following is the description of the switch mechanism operation performed when the button depression is made at other points. As shown in FIGS. 3A to 3C, when a point 14 on the pushbutton between the second and third switches 3b, 3c is depressed, the pushbutton operation transmission portion 7c is lowered pushing down one end of the second pushbutton operation receiver portion 8b and of the third pushbutton operation receiver portion 8c. As a result, these pushbutton operation receiver portions 8b, 8c are inclined twisting their second and third resilient arms 11b, 11c, and the lower ends of these pushbutton operation receiver portions 8b, 8c come into contact with the printed circuit board 4. The pushbutton 1 does not incline any further. At this time, the second and third switch activating portions 12b, 12c are not lowered and hence do not press the second and third switches 3b, 3c. As a result, the second and third switches 3b, 3c are not activated. As to the first and fourth pushbutton operation receiver portions 8a, 8d, since the first, second and fourth pushbutton operation transmission portions 7a, 7b, 7d are not pushed down, these pushbutton operation receiver portions are not acted upon, leaving the first and fourth switches 3a, 3d unoperated.

In FIGS. 1A to 1C, when the center portion on the surface of the pushbutton 1 is depressed, the pressing force is transmitted to the stay 9, which in turn pushes the printed circuit board 4. However, since this force does not affect the operation of the pushbutton mechanism, the switches 3a, 3b, 3c, 3d are not activated. As described above, only one of the switches 3a, 3b, 3c, 3d can reliably be activated by one pressing action.

Figure 4C:
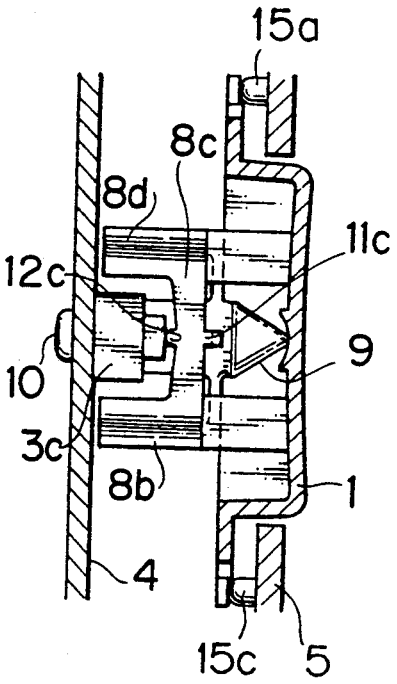
FIGS. 4A, 4B and 4C are cross sections showing another embodiment of the invention.
Figure 4A:
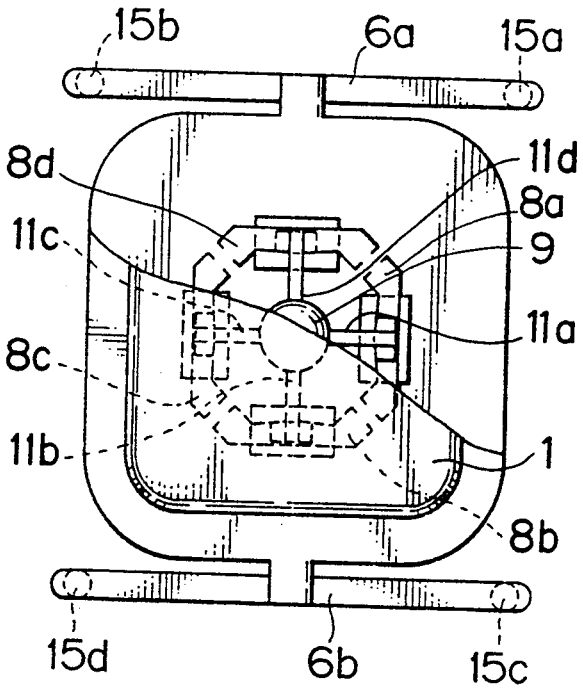
Figure 4B:
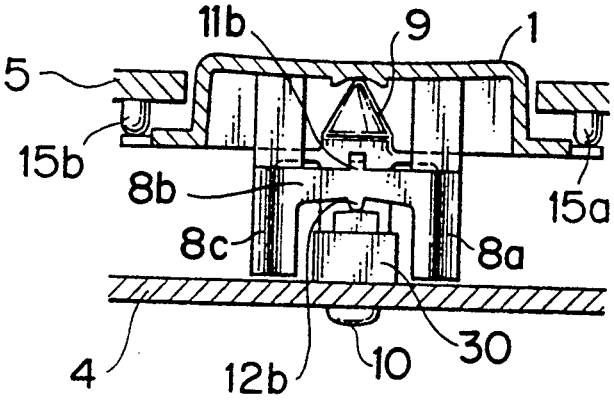
Figure 5C:
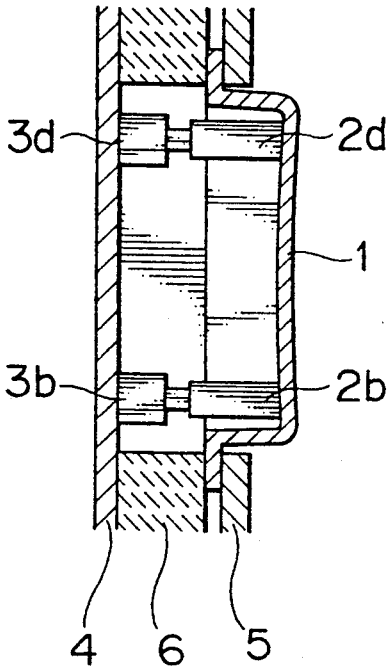
FIG. 5C PRIOR ART
FIGS. 5A, 5B and 5C are cross sections showing one example of a conventional pushbutton mechanism.
Figure 5A:
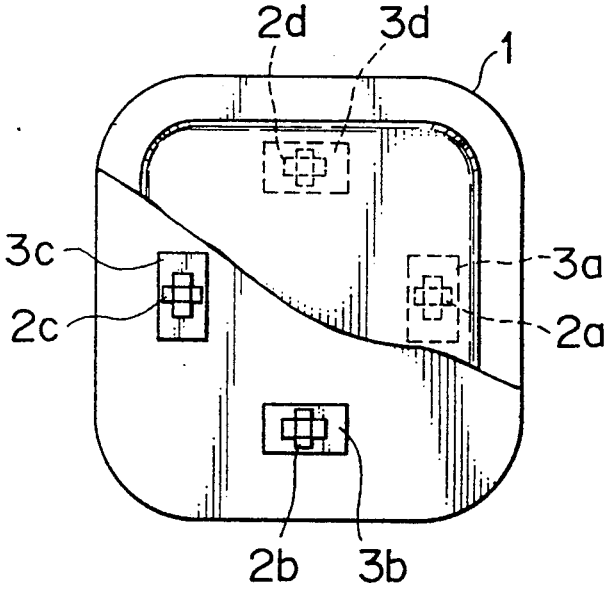
FIG. 5A PRIOR ART
Figure 5B:
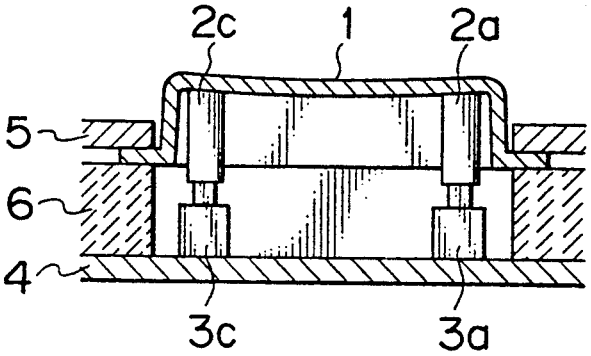
FIG. 5B PRIOR ART

In the above embodiment the cushion 6 is used to generate a recovering force of the pushbutton 1. This necessarily adds one part to the mechanism, increasing the material cost. Further, the cushion 6 gives a rather dull feeling when an operator depresses the pushbutton 1. In the following we will explain about a second embodiment in which other source of recovering force than the cushion 6 is employed. In FIGS. 4A to 4C, numerals 6a, 6b are first and second thin resilient arms formed integral with the pushbutton 1. The decorative panel 5 is fitted with first to fourth projections 15a, 15b, 15c, 15d that receive the four ends of the resilient arms 6a, 6b. Construction in other respects is the same as the first embodiment.

When the pushbutton 1 is depressed, the first and second thin resilient arms 6a, 6b are deflected between the first and second projections 15a, 15b and between the third and fourth projections 15c, 15d. When the depressing force is released, the recovering force of the first and second thin resilient arms 6a, 6b causes the pushbutton 1 to return to the initial position. By changing the thickness of the resilient arms, the desired recovering force can be obtained.

While in the above embodiments four switches are arranged on the printed circuit board 4, any number of switches may be used.

As described in the foregoing, with the pushbutton mechanism of this invention, a stay is secured to the printed circuit board at a center of a polygon formed by a series of switches arranged on the board; a plurality of pushbutton operation receiver portions, each of which has a switch activating portion formed at the center and placed in contact with the corresponding switch, are formed integral with, and suspended by, the stay through resilient arms that extend from the stay; and a pushbutton is supported by the stay and provided with pushbutton operation transmission portions each of which is adapted to press against the facing ends of the adjacent pushbutton operation receiver portions. This construction prevents two or more switches from being activated at once but allows the operation of only one switch at one time, regardless of the position at which, and of force with which, the pushbutton is pressed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pushbutton operated multiple switch assembly comprising:

a print circuit board;

a stay secured to the printed circuit board;

a plurality of switches arranged on the printed circuit board at predetermined intervals and at a predetermined distance from the stay;

a plurality of U-shaped pushbutton operation receiver portions each having a central portion and two depending leg portions, each leg portion being positionable above the printed circuit board with a space being defined therebetween, a switch activating portion being formed at the central portion and being placed over a corresponding switch, the switch activating portion being movable to depress the corresponding switch and the leg portions then engaging the printed circuit board, said pushbutton operation receiver portions being formed integral with, and suspended by, the stay through resilient arms that extend from the stay;

a pushbutton supported by the stay, the stay preventing a central portion of the pushbutton from being depressed, the pushbutton having a plurality of first and second areas, each of the first areas overlying a switch and the second areas overlying a position between adjacent switches; and a plurality of pushbutton operation transmission portions placed between the pushbutton and the pushbutton operation receiver portions, each of said pushbutton operation transmission portions being engaged with ends of two adjacent pushbutton operation receiver portions above one of the depending leg portions of the two adjacent pushbutton operation receiver portions, each of the pushbutton operation transmission portions being beneath one of the second areas of the pushbutton, and depression of one of the second ares of the pushbutton moving said pushbutton operation transmission portion to twist the two adjacent pushbutton operation receiver portions such that only one leg portion of each operation receiver portion adjacent the operation transmission portion is depressed while the other leg portion of each of the adjacent operation receiver portions remains above and out of engagement with the printed circuit board, whereby a switch is activated by the switch activating portion of one of the pushbutton operation receiver portions when the pushbutton is depressed in the first area overlying the switch and whereby a switch fails to be activated when the pushbutton is depressed in a second area due to one of the pushbutton operation transmission portions engaging the two adjacent pushbutton operation receiver portions to prevent depression of the switch activating portion of either adjacent pushbutton operation receiver portion with the corresponding switches.

2. The pushbutton operated multiple switch assembly as claimed in claim 1, wherein a recovering means is provided for returning the pushbutton to an original position when a depressing force is released.

3. The pushbutton operated multiple switch assembly as claimed in claim 2, wherein said recovering means includes a cushion provided between an upper surface of the pushbutton and a decorative panel.

4. The pushbutton operated multiple switch assembly as claimed in claim 2, wherein said recovering means comprises:

resilient arms formed integrally with the pushbutton; and projections fitted to a decorative panel at both ends of said resilient arms for receiving said resilient arms.

5. The pushbutton operated multiple switch assembly as claimed in claim 1, wherein the predetermined distance for each of the switches form the stay is uniform and wherein spacing between adjacent pushbutton operation receiver portions is generally uniform.

6. The pushbutton operated multiple switch assembly as claimed in claim 1, wherein four switches, four pushbutton operation receiver portions and four pushbutton operation transmission portions are provided.

7. The pushbutton operated multiple switch assembly as claimed in claim 6, wherein only one pushbutton is provided and wherein four first areas are provided on the pushbutton generally above the four switches.

8. The pushbutton operated multiple switch assembly as claimed in claim 1, wherein the resilient arms extending from the stay are generally uniformly distributed around the stay.

9. The pushbutton operated multiple switch assembly as claimed in claim 1, wherein the switch activating portion is located between the leg portions and the switch activating portion points downwardly, the corresponding switch being located beneath the switch activating portion.

* * * * *